US005379702A

United States Patent [19]

Saxton et al.

[11] Patent Number: 5,379,702

[45] Date of Patent: Jan. 10, 1995

[54] RAILROAD WELL CAR INCLUDING SPACER FOR SUPPORTING A TRAILER

[75] Inventors: Gregory J. Saxton, Portland, Oreg.; Gareth R. Thomas; Charles C. Hill, both of Del Mar, Calif.; Kenneth L. Weselake, San Diego, Calif.

[73] Assignee: Gunderson, Inc., Portland, Oreg.

[21] Appl. No.: 155,118

[22] Filed: Nov. 18, 1993

Related U.S. Application Data

[63] Continuation-in-part of Ser. No. 982,289, Nov. 24, 1992, Pat. No. 5,279,230.

[51] Int. Cl.[6] ..... B60P 3/00

[52] U.S. Cl. ..... 105/355; 105/372; 105/422; 410/84

[58] Field of Search ..... 105/355, 375, 422; 410/54, 52, 65, 30

[56] References Cited

U.S. PATENT DOCUMENTS

| | | | |
|---|---|---|---|
| 1,696,332 | 12/1928 | Sheehan . | |
| 1,875,584 | 9/1932 | Frede et al. . | |
| 2,052,213 | 8/1936 | Branstrator | 105/422 |
| 2,669,192 | 2/1954 | Osborn | 105/375 |
| 3,102,613 | 9/1963 | Johnston | 105/422 |
| 3,152,669 | 10/1964 | Johnston | 105/422 |
| 3,357,371 | 12/1967 | Gutridge | 410/52 |
| 3,415,205 | 12/1968 | Gutridge | 105/366 |
| 3,416,464 | 12/1968 | Gutridge | 410/54 |
| 3,420,192 | 1/1969 | Ellis | 105/422 |
| 3,444,824 | 5/1969 | Gutridge | 105/366 |
| 3,768,421 | 10/1973 | Gramse | 410/54 |
| 3,805,709 | 4/1974 | Schuller et al. | 105/366 |
| 4,091,742 | 5/1978 | Cordani | 105/366 |
| 4,288,957 | 9/1981 | Meehan | 105/422 |
| 4,456,413 | 6/1984 | Pavlick | 410/56 |
| 4,686,907 | 8/1987 | Woollam et al. | 105/418 |
| 4,703,699 | 11/1987 | Hill | 105/355 |
| 4,754,709 | 7/1988 | Gramse et al. | 105/355 |
| 4,771,706 | 9/1988 | Lindauer et al. | 105/415 |
| 4,782,762 | 11/1988 | Johnstone et al. | 137/355 |
| 4,826,371 | 5/1989 | Brown | 410/54 |
| 4,854,791 | 8/1989 | Brown | 105/355 |
| 4,862,810 | 9/1989 | Jamrozy et al. | 105/355 |
| 4,876,968 | 10/1989 | Lindauer et al. | 105/415 |
| 4,889,055 | 12/1989 | Jamrozy et al. | 105/355 |
| 4,949,646 | 8/1990 | Jamrozy et al. | 105/406 |
| 4,966,082 | 10/1990 | Takeichi et al. | 105/422 |
| 5,001,990 | 3/1991 | Pavlick | 105/375 |
| 5,017,066 | 5/1991 | Tylisz et al. | 105/355 |
| 5,074,725 | 12/1991 | Pavlick | 105/375 |

*Primary Examiner*—Mark T. Le

*Attorney, Agent, or Firm*—Chernoff, Vilhauer, McClung & Stenzel

[57] ABSTRACT

A railroad freight car including a cargo well for carrying optionally either intermodal cargo containers or highway semitrailers has a side sill structure including a deep rectangular top chord and a depending web, supporting a well floor structure. Each side sill has a height above the well floor, and a spacer is connected to the car body by an attachment which permits the spacer to be pivoted between a raised position clear of the well floor and a lowered position upwardly adjacent the well floor. The spacer has a predetermined height sufficient to support a trailer located in the cargo well, with its wheels resting on top of the spacer, high enough to locate lifting points on the trailer above the height of the side sill.

6 Claims, 13 Drawing Sheets

RAILROAD WELL CAR INCLUDING SPACER FOR SUPPORTING A TRAILER

This is a continuation-in--part of U.S. patent application Ser. No. 07/982,289 filed Nov. 24, 1992, now U.S. Pat. No. 5,279,230.

BACKGROUND OF THE INVENTION

The present invention relates to railroad freight cars, and particularly to a well car of lightweight construction, for optionally carrying either intermodal cargo containers stacked one upon another or over-the-highway trailers supported on their own running gear in the well.

Railroad cars for carrying over-the-highway trailers are well known, as; are railroad freight cars defining container wells for carrying various combinations of intermodal cargo containers stacked one upon another in two tiers. Because the total weight which can be carried upon the rails limits the net amount of cargo which can be carried on a railroad freight car, it is desirable for a well car to be constructed in a configuration having a minimum tare weight consistent with the strength required to safely support a combination of cargo containers for which the car is configured. It is also necessary, however, to provide an adequate surface to support the tires of trailers carried in the cargo well. Additionally, it is necessary for a car to be strong enough to withstand the many forces resulting from movement of the laden car as part of a train.

It is desired, then, to provide a well car having a floor defining an area sufficiently large and strong to support the wheels of laden trailers and also capable of carrying the concentrated stresses resulting from carriage of intermodal cargo containers, while still having a minimum tare weight.

It is also desirable to provide a well floor structure whose vertical height, or overall thickness, is kept small, in order to minimize overall height of the well car when it is laden with containers stacked atop one another.

It is also necessary to provide a shallow well depth from floor top surface to the top of side sill giving trailer loading equipment access to the bottom of a trailer floor above the side sills so that trailers can be inserted into and extracted from the well. The reduction of bending resistance resulting from shallower side sills must be restored by other structure.

In the past, well floor structures of satisfactory rigidity to support trailers have been more massive and greater in vertical thickness than is desired for well floor structures in a car intended to carry intermodal cargo containers stacked in two tiers, where the height of the center of gravity and the overall height of such a car when laden are of concern.

One of the particular problems encountered in the past in attempting to design a well car with a light, thin, and yet stiff and strong well floor has been the question of how to provide adequate strength in the areas of interconnection of such a well floor with the structure of the sides and end portions of such a car.

Previous attempts to provide the dual capacity for carrying containers or trailers have included cars incorporating transverse beams supporting substantial gratings on which to receive the tires of a trailer carried in the well, as disclosed in Paylick U.S. Pat. No. 4,456,413. While such cars provide ample strength for carrying both containers and trailers, the structure is undesirably heavy, and the well floor thickness is greater than desired, leaving less than the desired amount of vertical space available for stacked cargo containers. The car disclosed in Gutridge U.S. Pat. No. 3,357,371 has a similar lack of vertical clearance.

Jamrozy U.S. Pat. No. 4,949,646, and Lindauer et al. U.S. Pat. Nos. 4,876,968 and 4,771,706 all disclose a well car for carrying containers, in which a well floor structure includes transverse floor beams. Johnstone et al. U.S. Patent No. 4,782,762 discloses a well car including a floor with longitudinal and transverse beams, for carrying containers. Cordani U.S. Pat. No. 4,091,742 discloses a well car including a floor structure of transverse and diagonal beams for supporting containers-However, none of these patents discloses structure for supporting the wheels of a trailer carried in such a well.

Jamrozy et al. U.S. Pat. Nos. 4,889,055 and 4,862,810 disclose a well car including longitudinal channels, transverse channels, and a longitudinal center plate in a well floor structure, but there is no disclosure of structure available to support the wheels of a trailer in the container well.

Hill U.S. Pat. No. 4,703,699 discloses a lightweight side sill structure for a well car for carrying stacked containers, in which an opening is provided in one of a pair of parallel sheets of material, and a stiffener ring surrounding the opening connects the margins of the opening with the other of the two parallel sheets of material.

Other cars, such as those operated by Canadian National Railroad as its CN679500 "Improved Laser" series cars include heavy gratings supported on the flanges of 2hat-shaped transverse beams, providing structure of ample strength but greater than desired well floor thickness and weight.

As noted, well car dimensions are related to the structural strength required to safely support the anticipated cargo. Thus, it has been found that although a well car having a particular side sill height for sufficient strength is suitable for transporting most trailers, some types of trailers are difficult to load into and unload from these well cars because the side sill extends above the lift points of the trailers when such trailers are in the cargo well of the car.

Schuller et al., U.S. Pat. No. 3,805,709 discloses a railway flatcar with brackets adapted to support containers. Gutridge U.S. Pat. Nos. 3,415,205 and 3,444,824 disclose alternative mounting brackets for supporting containers on rail cars.

U.S. Pat. No. 3,357,371 to Gutridge discloses a container well car with a plank which may be moved from a stowed position below the upper surface of the cargo well floor to an operative position resting on the floor of the well car for supporting a trailer located in a railroad well car. However, because of the plank, the floor of the well car cannot provide the shallow depth preferred for a well floor in order to permit a pair of cargo containers to be stacked upon one another in the cargo well without the loaded car being too tall.

What is needed, then, is an improved structure for a railroad well car body for optionally carrying either stacked containers or trailers, in which a well floor structure and the connection of such a well floor to other parts of the car provide adequate strength without unnecessary weight, with shallow well depth and small floor thickness, and in which provision is made for supporting a trailer at a height sufficient to locate the lift points of a trailer above the top of the side sill.

SUMMARY OF THE INVENTION

The present invention provides an answer to the needs enumerated above and overcomes the aforementioned shortcomings of the prior art by providing a railroad freight car body having a cargo well defined by a pair of shallow longitudinal side sills of lightweight construction supporting a well floor of unified, lightened, and stiffened structure attached to the side sills to form a light, yet strong and stiff, car body structure. Such a car is capable of withstanding the concentrated loads imposed by cargo containers and has the necessary floor area of sufficient strength to support the wheels of trailers at any longitudinal location, and still is sufficiently light in overall weight to permit carriage of stacked intermodal cargo containers without undue limitation of their net cargo weight.

In a preferred embodiment of the invention the side sills include a deep rectangular top chord and a web of relatively thin material extending diagonally down to a well floor assembly. The well floor assembly is attached to the web continuously along its length, so that the well floor acts as a lower chord for the side sill, but is suspended beneath the top chord of the side sill along the entire length of the well floor.

The problems associated with the lading of certain trailers into railroad well cars having side sills of a certain height are also addressed in the present invention. Each side sill has a height above the well floor, and a spacer is connected to the car body by an attachment which permits the spacer to be pivoted between a raised position clear of the well floor and a lowered position upwardly adjacent the well floor. The spacer has a predetermined height sufficient to support a trailer located in the cargo well, with its wheels resting on top of the spacer, high enough to locate lifting points on the trailer above the height of the side sill.

Unless a trailer requiring its use is present in the well car, the spacer can remain in the raised position, adjacent the side sill, where it will not affect the location of trailers or cargo containers in the cargo well. When certain trailers are to be loaded into the cargo well the spacer can be pivoted down to a lowered position resting atop the well floor, where it provides a horizontal top surface to support the wheels of the trailer at a predetermined height above the well floor, and thus locates the lifting points of the trailer above the side sill.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figure 1:
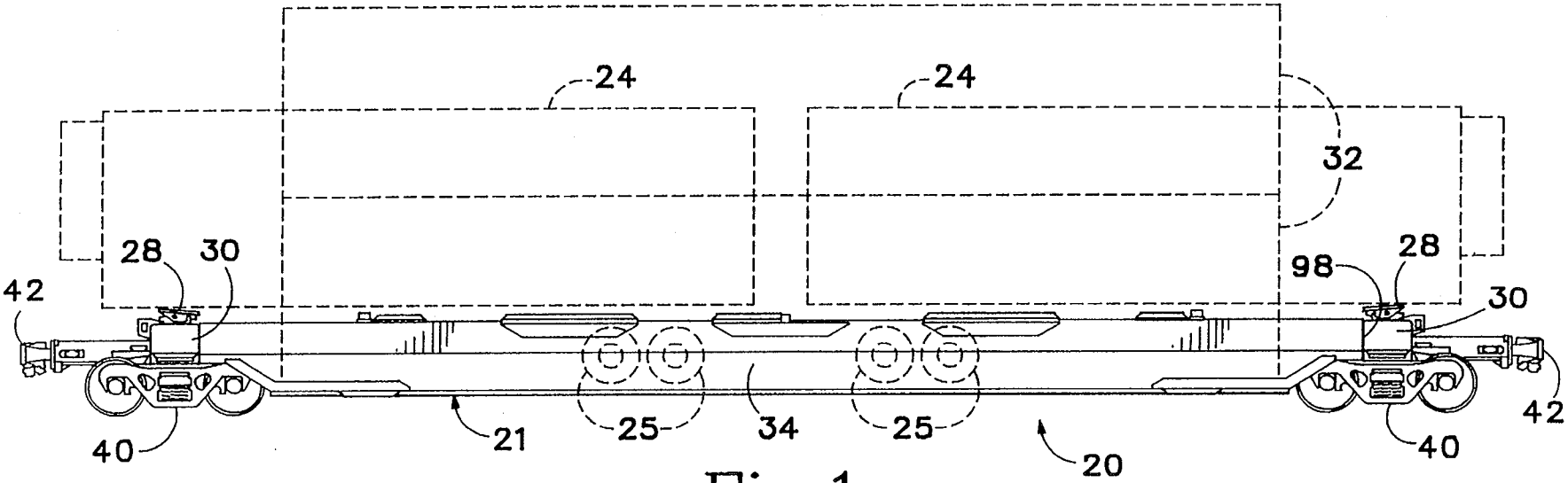
FIG. 1 is a side elevational view of a railroad freight car embodying the present invention and laden with a pair of semi-trailers carried in a cargo well defined in the car body.
Figure 2:
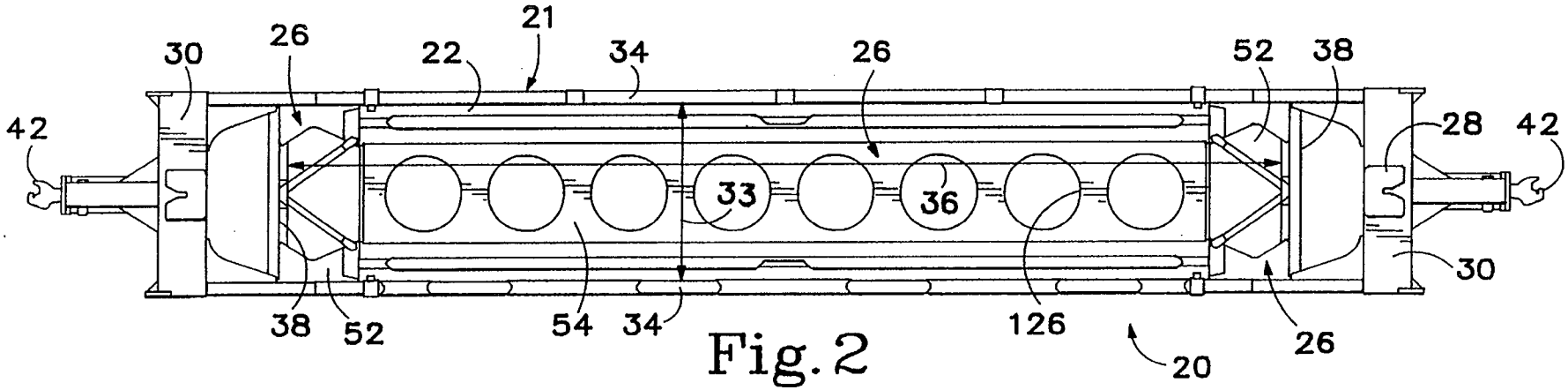
FIG. 2 is a top plan view of the railroad car shown in FIG. 1.

Referring first to FIGS. 1 and 2 of the drawings which form a part of the disclosure herein, a railroad freight car 20 has a car body 21 of welded steel which includes a cargo well 22 adapted to be laden by receiving trailers 24. As shown in phantom line in FIG. 1, the wheels 25 of the trailer rest on a floor assembly 26 which helps to define the cargo well 22, and a kingpin portion near the front of each trailer 24 is secured to and supported on a fifth wheel trailer hitch 28 mounted atop a body bolster 30 located at a respective end of the car 20. Alternatively, intermodal cargo containers 32, also shown in phantom line in FIG. 1, may be carried in the cargo well 22, where two of such cargo containers can be stacked one upon another, supported by the floor assembly 26, within the vertical clearance space available along most railroads.

The well 22 has a width 32, defined between a pair of opposite side sills 34, and a length 36, defined between a pair of vertical transverse stiffeners 38. The length and width are great enough to receive a cargo container having a long standard length, such as 48 feet, and a wide standard width such as 102 inches, or to receive a pair of short standard containers each 20 feet long.

A conventional four-wheeled truck 40 located under each body bolster 30 supports the car 20 on a rail-road track (not shown), and conventional couplers 42 are provided at the ends of the car 20.

As may be seen in FIGS. 3–8, each of the side sills 34 includes a deep rectangular top chord 44 in the form of a longitudinal channel 45 of bent plate, ¾ inch thick, for example, including a pair of flanges 46, extending horizontally outward. A ¼-inch-thick (for example) web plate 48 of the side sill 34 is welded to the flanges 46 extending vertically between them to close the top chord 44 and extends thence diagonally downwardly and inwardly as a lower panel 50 acting as a web of the side sill 34. A reinforcing angle member 49 welded to the plate 48 extends horizontally between the flanges 46 to reinforce the top chord 44 against buckling without adding an undesirable amount of weight. The lower panels 50, however, are essentially planar between the point of attachment to the respective lower flange 46 and lower margins of the panels 50, and thus carry bending forces from the floor assembly into the top chords 44 of the side sills 34. The side sills 34, thus, are very clean structurally with no additional major reinforcement members.

The well floor assembly 26 is of welded metal construction and is attached to and supported by lower panels 50 of the side sills 34, extending horizontally between them. Opposite end transition portions 52 of the floor assembly 26 are also attached to the lower panels 50 as well as to the vertical transverse stiffeners 38 which define the length 36 of the well 22. The end transition portions 52 carry longitudinal loads from the main portion 54 of the floor assembly 26 to the side sills 34 and to the transverse stiffeners 38 at each end of the car body 21.

Between the well floor end transition portions 52, the main portion 54 of the well floor assembly 26 is an integral rigid welded assembly, including a bottom plate 56 which may be in the form of two opposite side portions each about half the width of the floor assembly 26, extending horizontally for the length of the main portion 54 of the floor assembly 26 and joined together along a longitudinal center joint. The bottom plate 56 may be, for example, 3/16 inch thick.

A longitudinally extending transition channel member 58, of bent plate 7/16 thick, for example, extends along the top of each lateral margin of the bottom plate 56. The transition channel members 58 are specially configured, with a cross-section shape that includes a V-shaped channel portion 60 which has a pair of sides including a diagonally upwardly-and-outwardly directed outer flange portion 62. As may be seen best in FIG. 5, a bottom portion of the V-shaped channel 60 is welded to the lateral margin 64 of the bottom plate 56, while an upper margin of the outer flange portion 62 overlaps and is welded to the inner side of a lower margin 66 of the lower panel 50 of the web sheet 48, so that the floor assembly 26 is suspended from the top chords 44 and extends horizontally between the two side sills 34. Each transition channel member 58 further includes a horizontal transverse portion 68 connected with the other side of the channel 60, and a vertical flange portion 70 extending down from the transverse portion 68 and whose margin is welded to the top side of the bottom plate 56. Thus, the transition channel members 58 resemble a radical, or square root, sign.

The well floor end transition portions 52 each include a pair of transition plates 72 forming the lateral margins of the end transition portions 52. The transition plates 72 are 7/16 inch thick, for example, and extend from each end of the main portion 54 of the floor assembly 26 toward the respective vertical transverse stiffened member 38. Each transition plate 72 is welded to the inwardly extending transverse horizontal lower flange 74 of the respective stiffener 38, as may be seen best in FIG. 3.

A pair of diagonal box beams 76 extend from respective portions of the transition plates 72 adjacent the main portion 54 of the floor assembly 26, converging toward each other, and are welded to a central portion of the horizontal lower flange 74 of the respective transverse stiffener 38. The box beams 76 may be two inches by four inches overall in cross-section size, with a wall thickness of ⅛ inch, for example. A top cover plate 78 is welded to the tops of the beams 76. The top cover plate 78 extends down alongside the outer ends of the box beams 76 and is also welded to the flange 74 to further strengthen the attachment of the outer ends of the beams 76 to the transverse stiffener 38.

Figure 3:
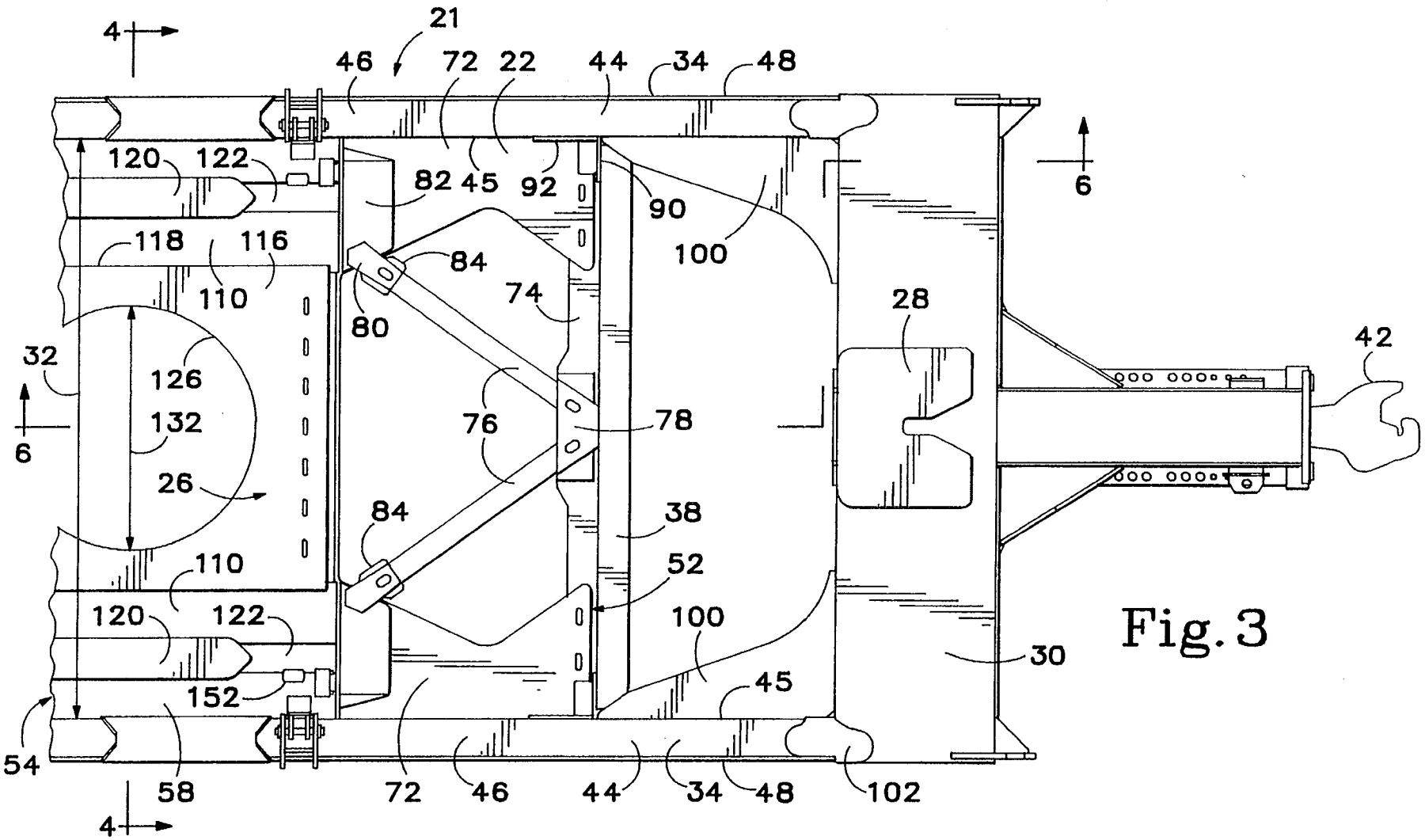
FIG. 3 is a top plan view, at an enlarged scale, of a portion of the car shown in FIGS. 1 and 2.
Figure 4:
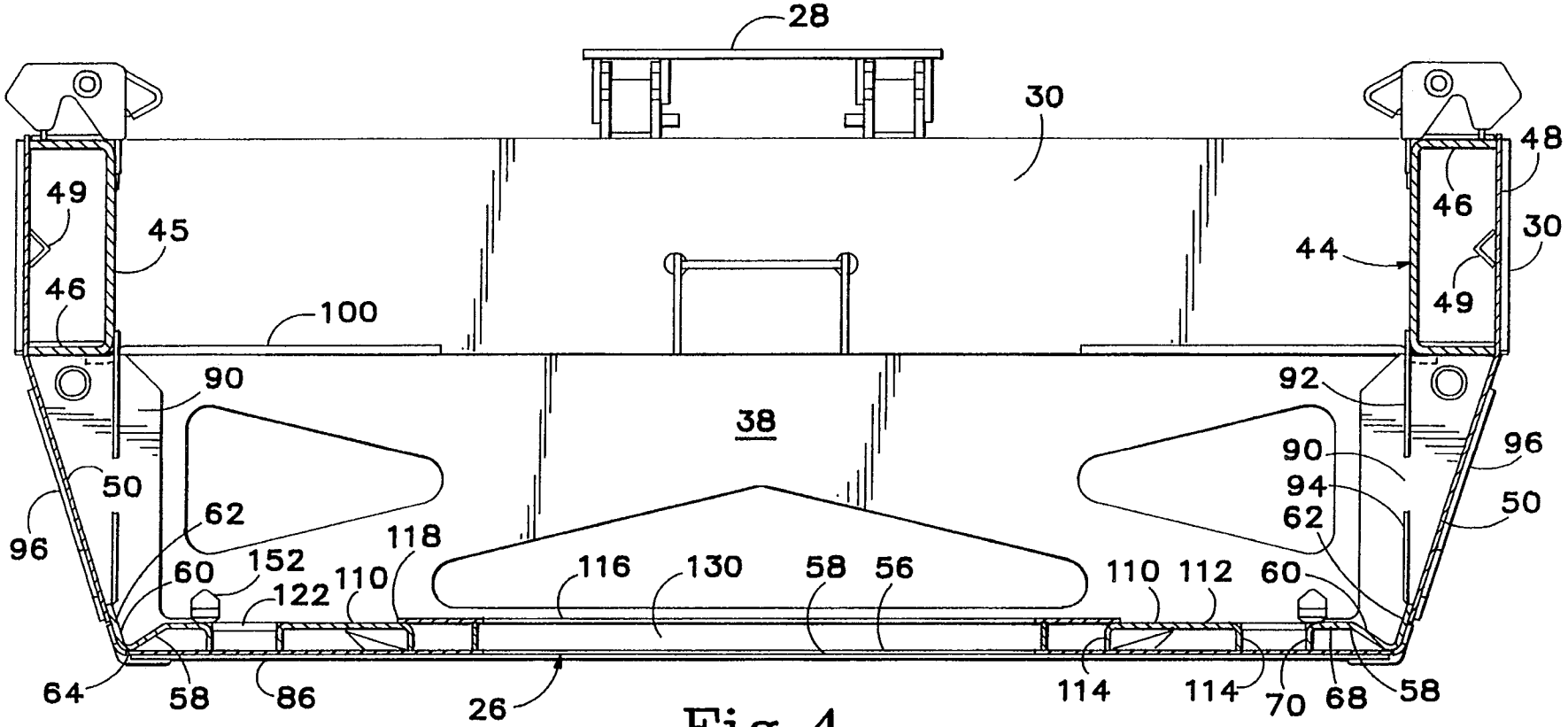
FIG. 4 is a sectional view of the body of the railroad freight car shown in FIGS. 1–3, taken along line 4—4 in FIG. 3, at an enlarged scale.
Figure 5:
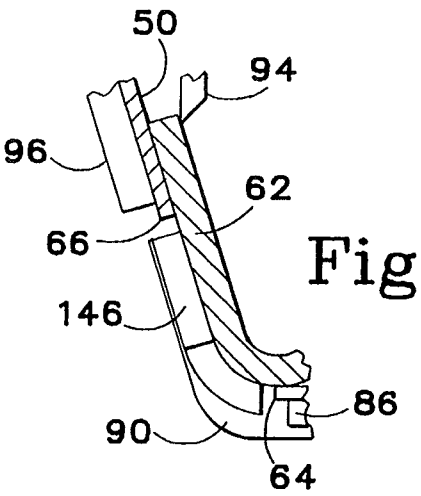
FIG. 5 is an enlarged sectional view of a detail of the portion of a railroad freight car body shown in FIG. 4.
Figure 6:
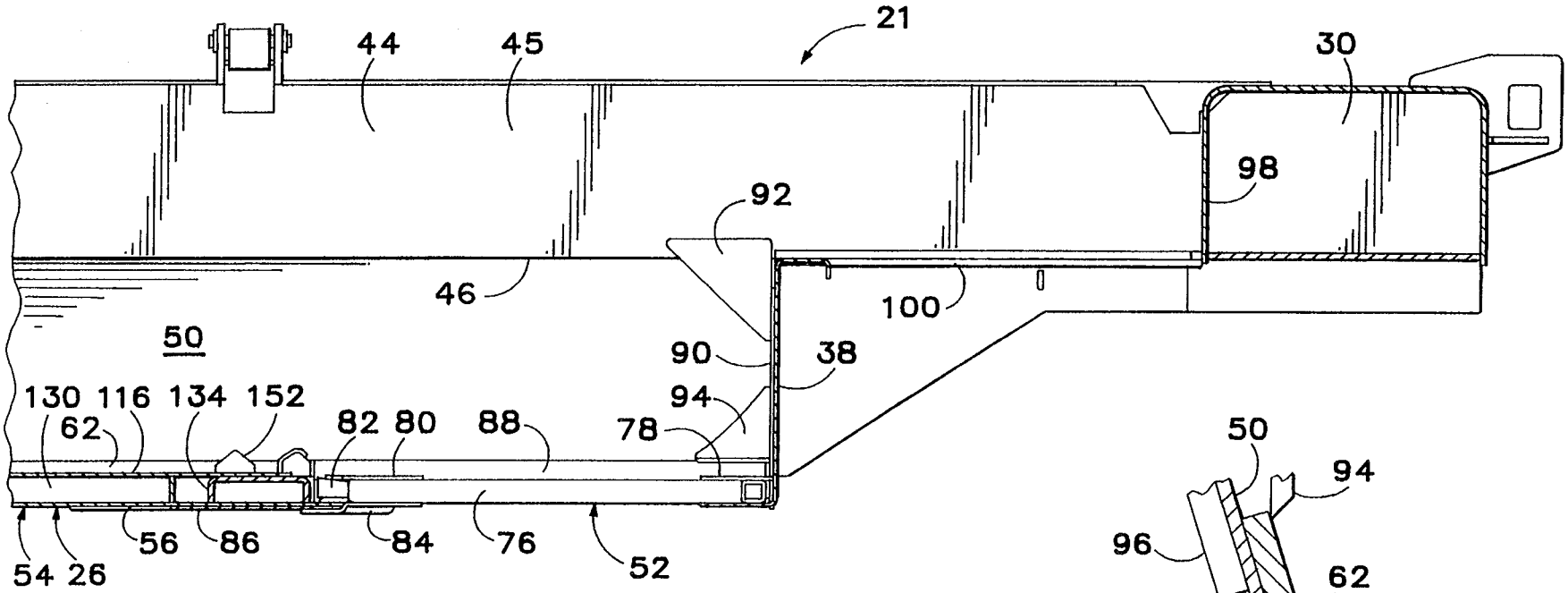
FIG. 6 is a sectional view of a portion of the body of the railroad freight car shown in FIGS. 1–3, taken along line 6—6 of FIG. 3, at an enlarged scale.
Figure 7:
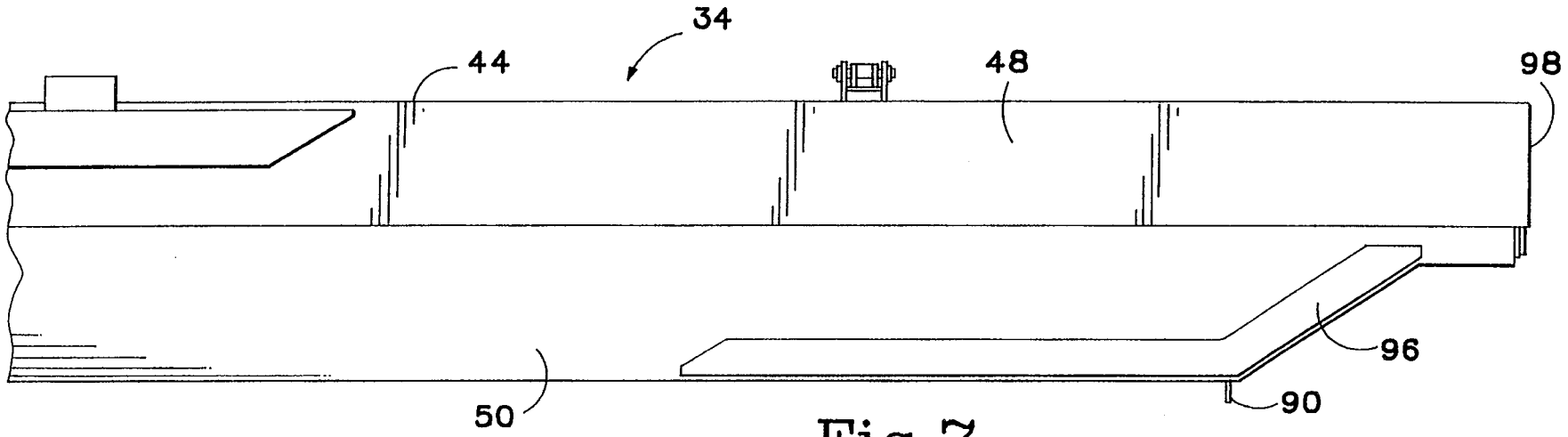
FIG. 7 is a side elevational view of a portion of a side sill of the railroad freight car shown in FIG. 1, at an enlarged scale.
Figure 8:
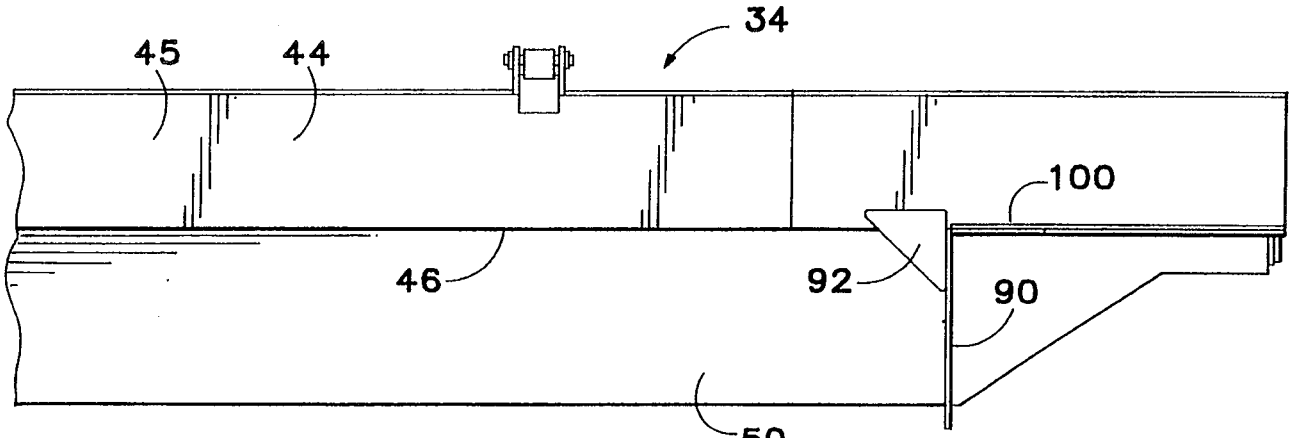
FIG. 8 is a side elevational view, at an enlarged scale, of a portion of a side sill shown in FIG. 1, taken in the direction indicated by the line 6—6 in FIG. 3.

Similarly, as shown also in FIGS. 3 and 6, a top attachment plate 80 is welded to the top of the other, or longitudinally inner, end of each of the beams 76 to attach it to the top of a respective transition ramp member 82 which forms a part of the attachment of the main portion 54 of the floor assembly 26 to the transition plate 72. A bottom attachment plate 84 also cooperates in attachment of the inner ends of the beams 76 to the transition plates 72, through a doubler plate 86 which is attached to the lower faces of the bottom plate 56 and the transition plate 72. The cover plates 78 and attachment plates 80 and 84 may all be 3/16 inch thick, for example.

A diagonally upwardly-and-outwardly extending flange 88 is a portion of each transition plate 72 and is welded to the lower margin 66 of the lower panel 50 of the web sheet 48 to attach the laterally outer margins of the transition plates 72 to the side sills 34.

A stub transverse stiffener 90 (FIGS. 4, 6, and 8) similar in thickness to the transverse stiffeners 38 supports the lower panel 50 of each web sheet 48 beneath the top chord 44 immediately adjacent the transverse stiffener 38, and is welded to the transverse stiffener 38 to interconnect it securely with the side sills 34 and define the end of the cargo well 22. A gusset 92 of similar material interconnects the stub transverse stiffener 90 with the channel 45 of the top chord 44, and a gusset 94 interconnects the upper margin of the outer flange portion 62 of the transition channel member 58 with the stub transverse stiffener 90.

The outer ends 98 of the side sills 34 are welded to each of the body bolsters 30. The body bolsters 30 are transversely-extending box beam structures similar to those used in other railroad well cars of recent design for carrying stacked intermodal cargo containers. The longitudinally outer portions of the lower panel 50 of each side sill 34, the portions extending beyond the transverse stiffeners 38, are diagonally tapered upwardly toward the top chord 44, providing clearance for the truck 40. A doubler plate 96 is provided on the outer side of the lower panel 50 to reinforce the margins of the lower panel 50 on each side of the transverse stiffeners 38.

Large, generally triangular, horizontal gusset plates 100 extend from the top flange of the transverse stiffener 38 to the lower portion of the body bolster 30. The gusset plates 100 carry substantial loads to the body bolster 30, and are therefore of substantial thickness, for example ¾ inch. An outer side margin portion of each gusset 100 extends beneath and is welded to the lower flange 46 of the respective top chord channel member 45, as seen best in FIG. 4. Reinforcing plates 102 strengthen the interconnection of the top flange 46 of the chord 44 of each side! sill to the body bolsters, as shown in FIG. 3.

Referring now also to FIGS. 9–17, the longitudinally centrally located main portion 54 of the floor assembly 26 includes a pair of downwardly-open longitudinal channels 110, extending longitudinally of the floor assembly 26, each spaced laterally inward from and parallel with a respective transition channel member 58. Each longitudinal channel 110 may be of bent plate 7/16 inch thick, for example, and has a horizontal web 112 and a pair of vertical flanges 114 of equal size so that the web 112 is parallel with the bottom plate 56. The height of the longitudinal channels 100 is equal to that of the horizontal portion 68 of the longitudinal transition channels 58.

A generally rectangular top plate 116 extends horizontally between the longitudinal channels 110 and has its lateral margins 118 welded respectively to the inboard shoulder of the downwardly open longitudinal channel 110 on each side, so that the top plate 116 of the floor assembly 26 is spaced upwardly apart from the bottom plate 56 by a distance equal to the height of the longitudinal channel 110.

A cover plate 120, 7/16 inch thick, for example, is welded atop the confronting shoulders of each transition channel 58 and the nearby downwardly open longitudinal channel 110 to form an upper surface. The cover plate 120 is additionally supported by heavy doubler plates 122 ⅝ inch thick, for example, located between the confronting vertical flanges 114 and 70 at the positions along the length of the floor assembly 26 where concentrations of weight are to be expected. Doubler plates 122 are thus provided where the ends of a pair of end-to-end cargo containers are to be supported at the mid point of the length 36 of the well 22, and at the ends of the main portion 54 of the floor assembly 26, adjacent the transition plates 72, where the corner posts of the outer ends of containers are to be supported on locator cones. At the locations where the container corner castings are to be located the cover plate 120 is omitted, to provide a small amount of additional clearance.

The transition channel member 58, the cover plate 120, the doubler plate 122, and the longitudinally extending channel 110 all cooperate with the lower panel 50 of the web sheet 48 of the respective side sill 34 to carry loads which would be carried by a lower chord of the side sill 34 if one existed. Additionally, the horizontal transverse portion 68 of the transition channel members 58, the cover plates 120, and the horizontal webs 112 of the longitudinal channels 110 include suitably strong upper surfaces of the floor assembly 26 to support the wheels 25 of trailers 24 carried in the well as shown in FIG. 1.

Figure 10:
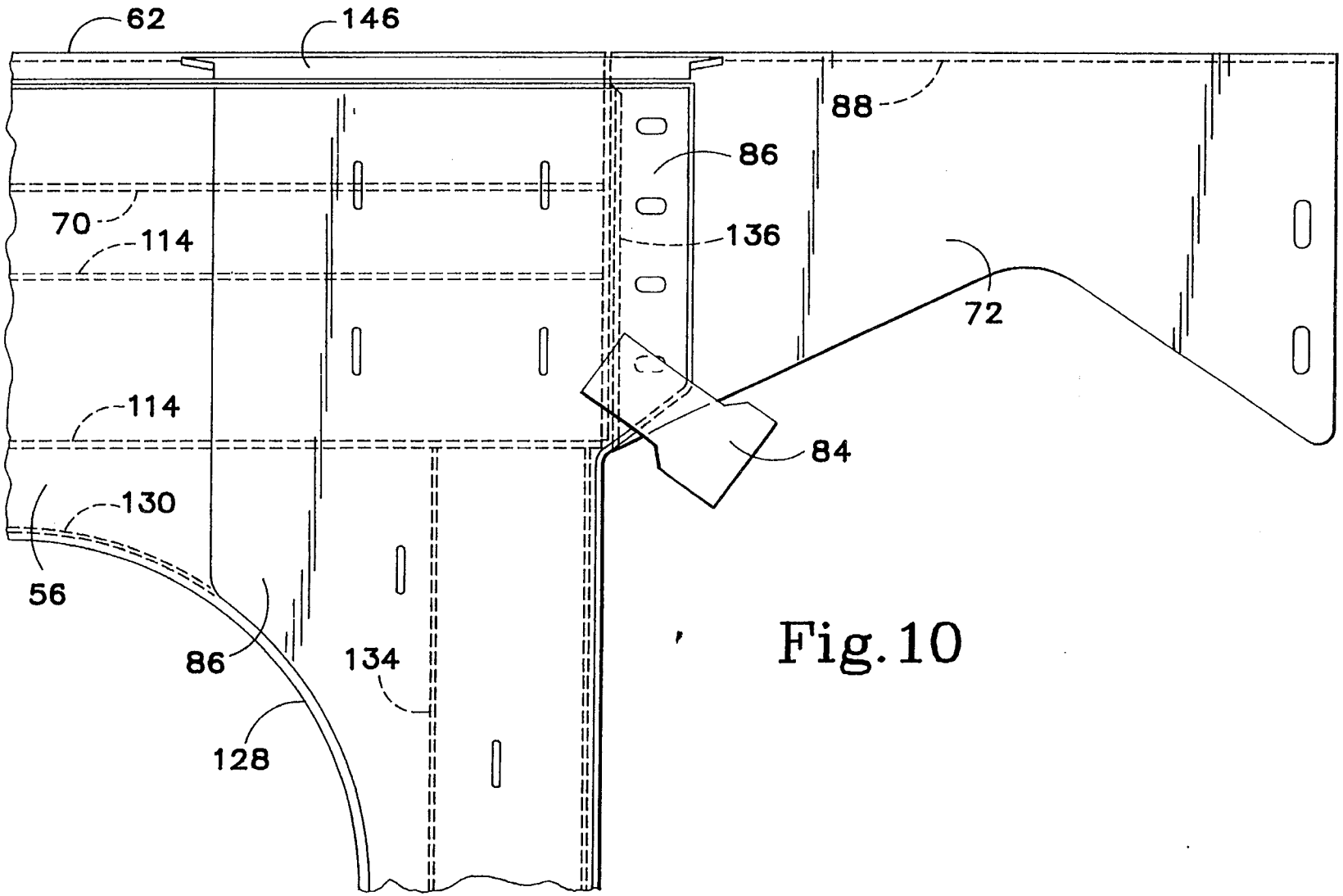
FIG. 10 is a bottom view of part of the portion of a well floor assembly shown in FIG. 9.
Figure 11:
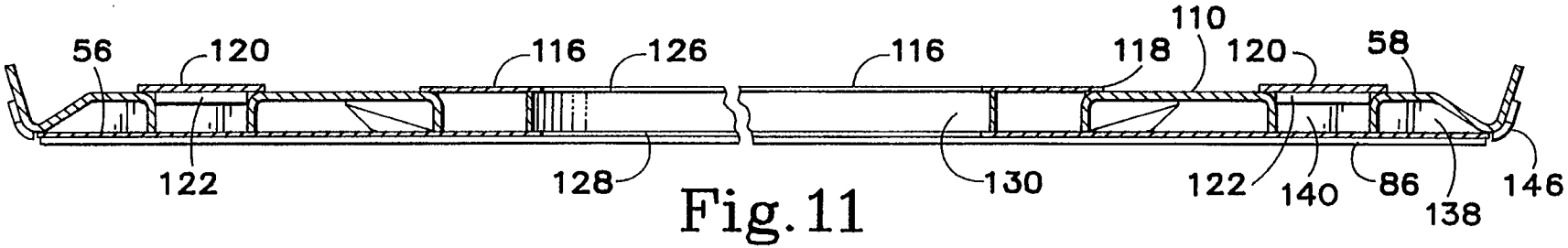
FIG. 11 is a sectional view, at an enlarged scale, of a portion of the well floor assembly shown in FIG. 9, taken along line 11—11.
Figure 12:
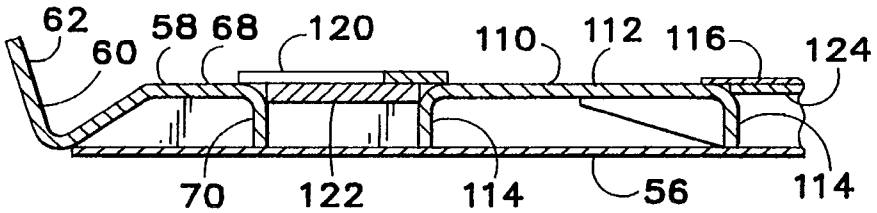
FIG. 12 is a sectional view, at an enlarged scale, of a portion of the well floor assembly shown in FIG. 9, taken along line 12—12.
Figure 13:
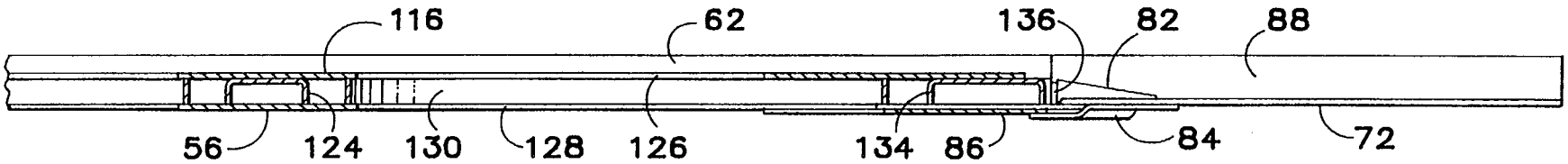
FIG. 13 is a sectional view, at an enlarged scale, of a portion of the well floor assembly shown in FIG. 9, taken along line 13—13.

The floor assembly 26 is further strengthened by several transversely extending beams in the form of downwardly-open channels 124, of bent plate 5/16 inch thick, for example, whose flanges are welded to the bottom plate 56 at locations spaced apart longitudinally along the main portion 54 of the floor assembly 26. The top plate 116 is welded to the web of each transverse channel 124 through conventional openings provided for that purpose. A similar but wider transversely extending end channel 134 is located at each end of the main portion 54 of the floor assembly, as shown in FIGS. 6 and 10.

In order to provide additional stiffness while also reducing the weight of the bottom assembly 26, the bottom plate 56 and the top plate 116 each respectively define several large openings 126 and 128, preferably circular in shape, of equal size, and located directly above one another. A stiffener 130 extends vertically between the bottom plate 56 and top plate 116 and surrounds the large openings 126 and 128. The stiffener 130 is of metal plate material ¼ inch thick, for example, forming a circular wall enclosing the large openings 126 and 128. The stiffened 130 is welded to both the bottom plate 56 and top plate 116 about the entire periphery of the large openings 126 and 128, interconnecting the top plate 116 and the bottom plate 56 as a stiff structure. The height of the longitudinal channels 110, establishing the distance separating the bottom plate 56 from the top plate 116, may be 2-9/32 inch, for example, and the stiffener 130 correspondingly would have a height of 2-¼ inches.

In a car 20 in which the length 36 of the well 22 is slightly greater than 48 feet, in order to receive a nominally 48-foot-long cargo container, preferably eight sets of corresponding vertically aligned large openings 126, 128 are provided, each having a diameter 132 of 44 inches, with the circular stiffeners 130 having an inside diameter of 45 inches, providing an overhang of about ½ inch of the margins of the top plate 116 and bottom plate 56 inside the stiffeners 130 to allow for convenient welding and stress relief.

As shown also in FIGS. 9, 10, 12 and 13, the transverse channel members 124 are located between the adjacent large openings, and the similar, but wider, transverse end channels 134 are located between the top plate 116 and bottom plate 56 at each end of the main portion 54 of the floor assembly 26, adjacent the well floor end transition portions 52.

In order to provide adequate strength for transfer of loads from the main portion 54 of the well floor assembly 26 to the end transition portion 52 at each end, and ultimately to the body bolster 30, a respective doubler plate 86 is welded to the underside of the bottom plate 56 adjacent each end of the main portion 54, extending about two feet toward the center of the length of the car body 21. A portion of the doubler plate 86 extends longitudinally outward beyond the wide transverse end channel member 134 at each end of the main body portion 54 and is welded to the bottom side of the respective transition plate 72 at each side of the floor assembly 26. The respective bottom attachment plate 84 for each diagonal box beam 76 is bent to fit closely along the bottom side of the doubler plate 86 and extends thence along the bottom side of the transition plate 72.

An end cap 136 extends vertically and transversely across the ends of the transition channel member 58 and the downwardly open longitudinal channel 110 on each side at each end of the main portion 54. Each transition ramp 82 is welded to the respective end cap 136 and extends slopingly from it to the top surface of the transition plate 72.

Figure 9:
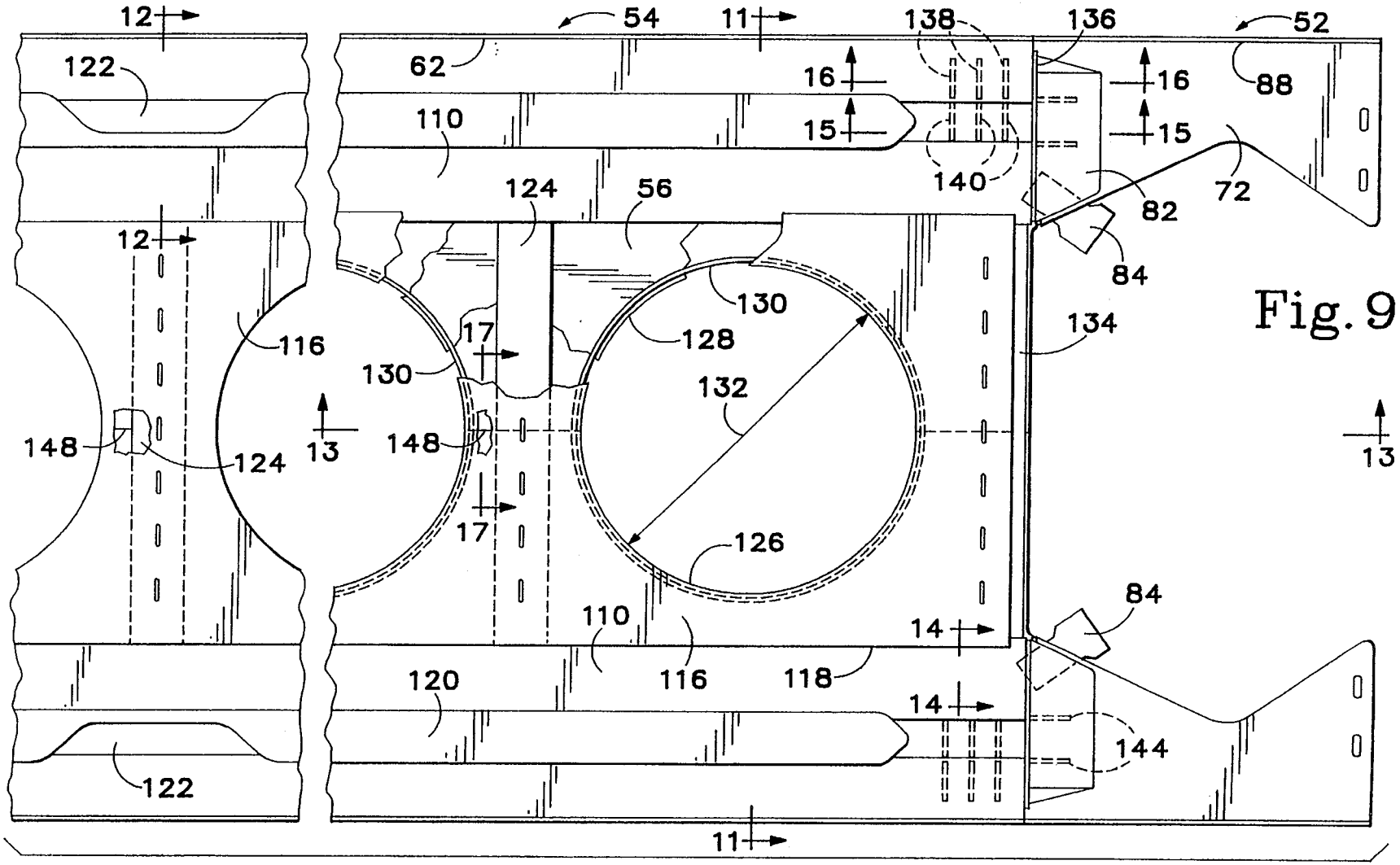
FIG. 9 is a partially cut-away, top plan view, at an enlarged scale, of a portion of the well floor assembly of the railroad freight car shown in FIGS. 1–3.
Figure 15:
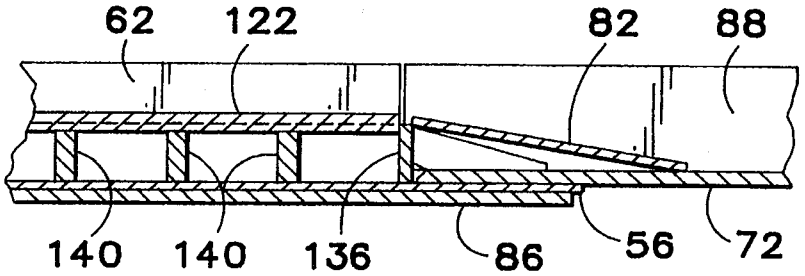
FIG. 15 is a sectional view, at an enlarged scale, of a portion of the well floor assembly shown in FIG. 9, taken along line 15—15.
Figure 14:
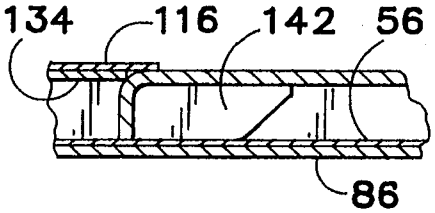
FIG. 14 is a sectional view, at an enlarged scale, of a portion of the well floor assembly shown in FIG. 9, taken along line 14—14.
Figure 16:
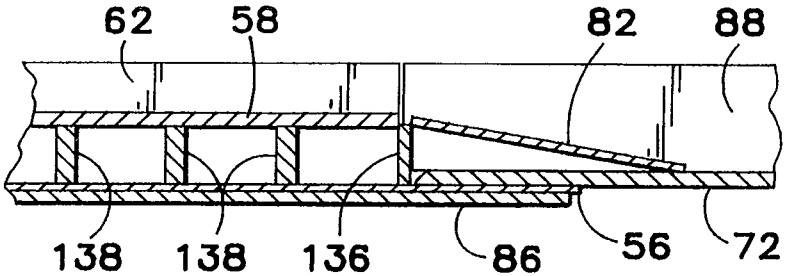
FIG. 16 is a sectional view, at an enlarged scale, of a portion of the well floor assembly shown in FIG. 9, taken along line 16—16.

Groups of transverse reinforcing pieces 138 and 140 extend vertically between the bottom plate 56 and the underside of the transition channel member 58 and the doubler plate 86, respectively, near each corner of the main portion 54 of the floor assembly 26, as shown in FIGS. 9, 15, and 16. A transition plate 142, shown in FIGS. 9 and 14, provides additional support for the longitudinal channel member 110 at each end of the main portion 54, extending vertically and laterally adjacent the end cap 136.

A "J"-shaped doubler 146 is located on the outer side of the floor assembly 26, below a part of the horizontal portion of each doubler plate 96 near the lower margin of each side sill 34. The J-shaped doublers 146 extend longitudinally over a distance extending slightly beyond the doubler plate 86, and thus reinforce a portion of the outer flange 88 of each transition plate 72 and a portion of the outer flange 62 at each end of each transition channel member 58. The outer diagonal flange 88 of each transition plate 72 also aids in the transmission of forces from the main portion 54 of the floor assembly 26 to the end transition portions 52.

Figure 17:
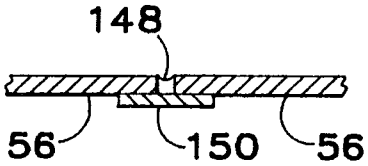
FIG. 17 is a sectional view, at an enlarged scale, of a portion of the well floor assembly shown in FIG. 9, taken along the line 17—17.

As shown in FIG. 17, except at the mid-length location along the floor assembly 26 the two longitudinally-extending halves of the bottom plate 56 are joined by a weld 148 and reinforcing a cover strip 150 extending longitudinally of the floor assembly 26 on the bottom side, at the ends of the main portion 54 and between the large openings 126 at places other than the mid-length location. However, at the mid-length position the cover strip 150 is preferably not used where track clearance height beneath the car is most critical.

Standard cargo container locator cones 152 are supported upon the reinforced portions of the corners of the main portion 54 of the well floor assembly 26, where the doubler plates 122 are not covered by the cover plates 120. At the mid-length portion of the car, between the middle pair of large openings 126, 128, the doubler plates 122 are also partially exposed as a landing spot for the corner posts of each of a pair of short containers carried end-to-end within the cargo well 22 as shown in FIG. 1.

Referring now to FIGS. 18–21, a railroad well car 158 which is another embodiment of the present invention has a car body 160 which includes four pivoting spacers 162 which can be moved between respective lowered, operative positions and raised, stowed positions as will be explained presently in greater detail. The car body 160 is largely similar to the car body 21 previously described, and like structures are identified by like reference numerals in FIGS. 18–21.

Figure 18:
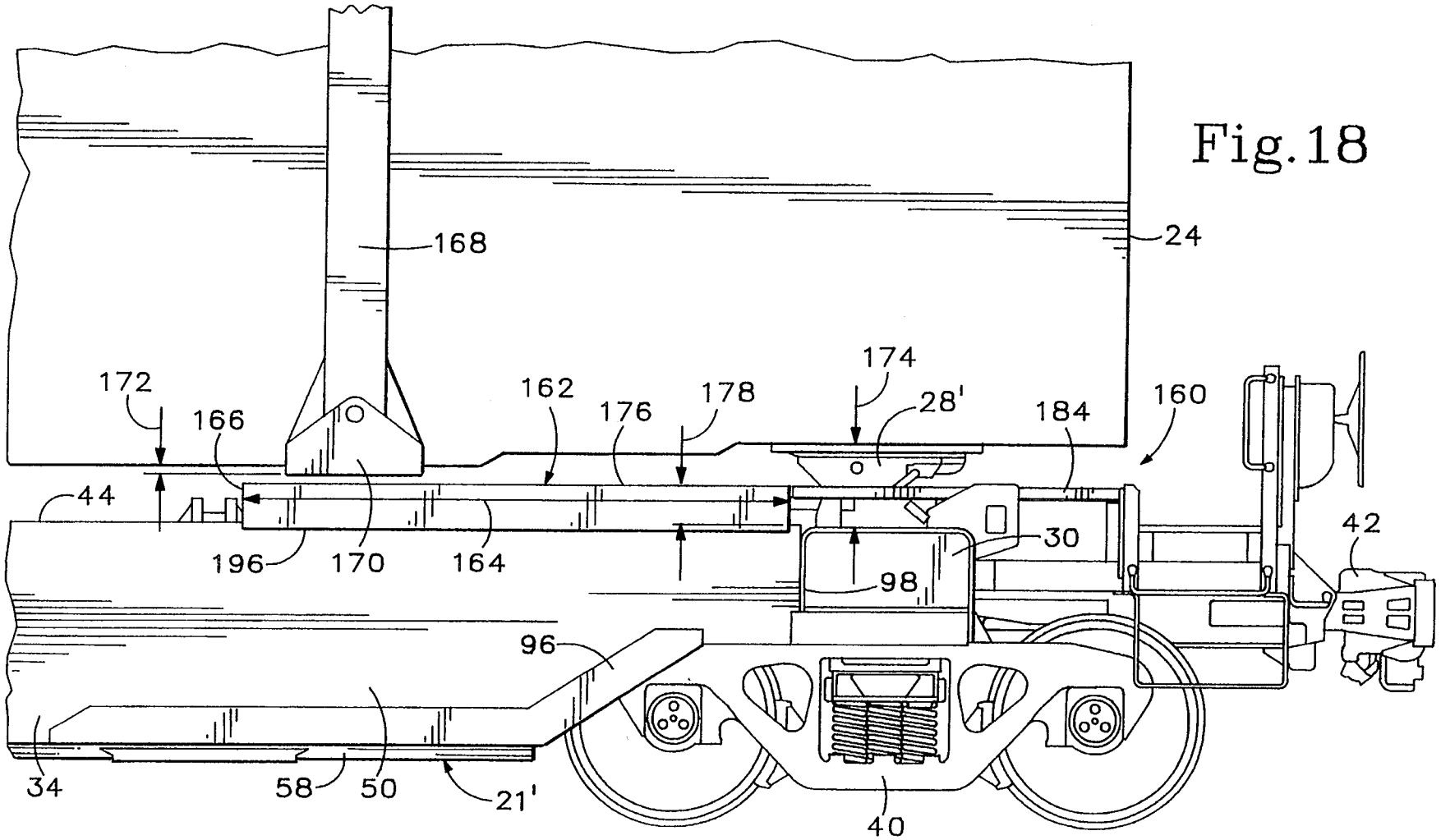
FIG. 18 is a side elevational view of a portion of a rail car including a movable spacer which embodies a further feature of the present invention, with trailers carried in the car shown in phantom line.
Figure 19:
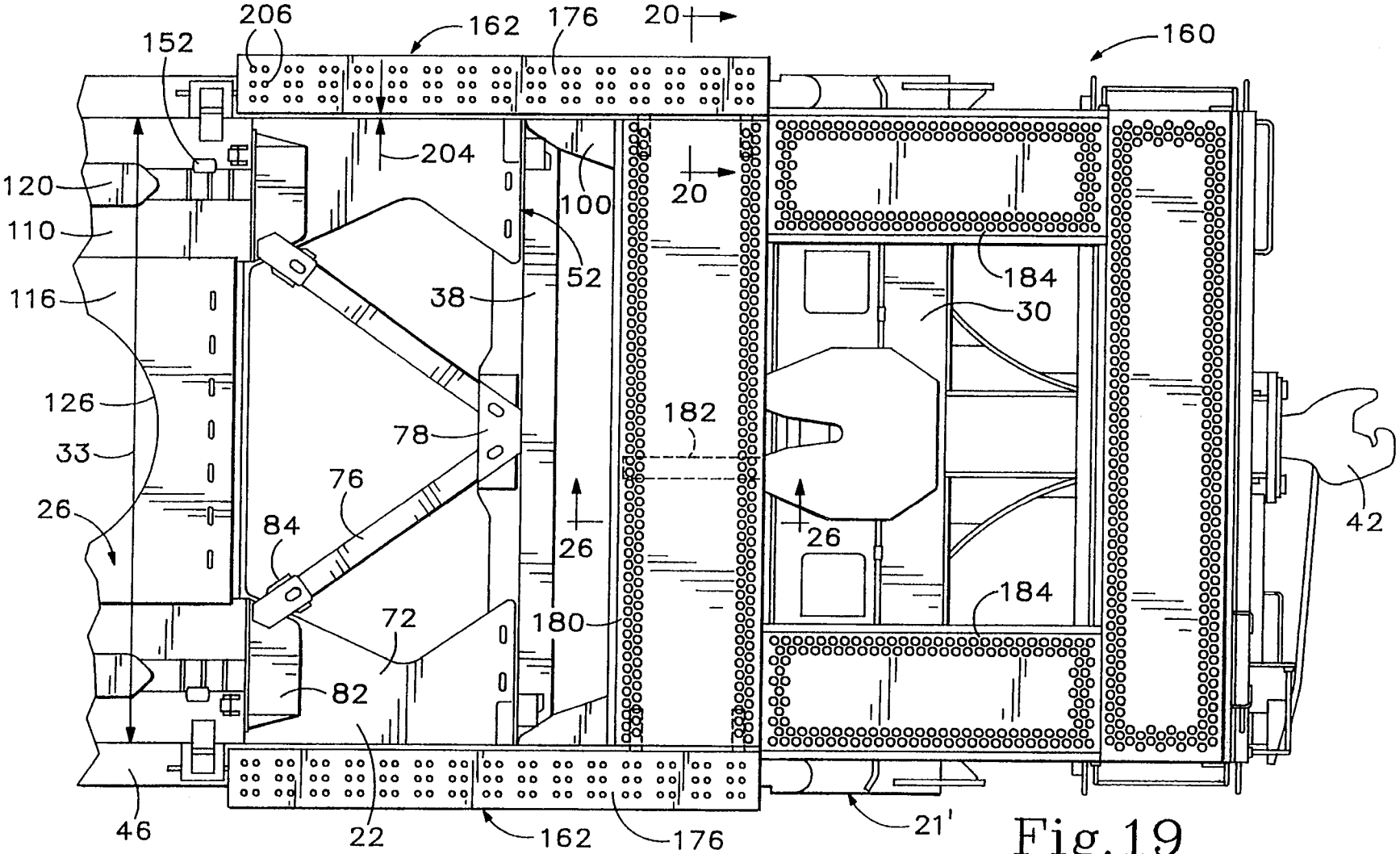
FIG. 19 is a top plan view of the portion of a rail car shown in FIG. 18.

As shown in FIGS. 18 and 19, the car body 160 includes two longitudinally extending side sills 164 and a horizontal well floor 166, which help to define a cargo well 22. Each side sill 164 includes a top chord 168 and a web 171. The top chord 168 includes an outwardly-facing longitudinal channel 169 of $\frac{5}{8}$ inch bent steel plate, for example, and a plate 170. The plate 170, which may be of $\frac{1}{4}$ inch steel plate, is attached to and closes the open side of the channel 169. The web 171 extends diagonally downward and inward from the plate 170 of the top chord, and preferably is an extension of the plate 170. A reinforcing member 172 is located in the longitudinal channel 169 to reinforce the longitudinally central part of the top chord along approximately one third of its length. The well floor 166, which includes a transition channel member 58, extends laterally between and is supported by the side sills 164 generally in the same way in which the floor assembly 26 is supported by the side sills 34 in the railcar 20 described above.

Figure 20:
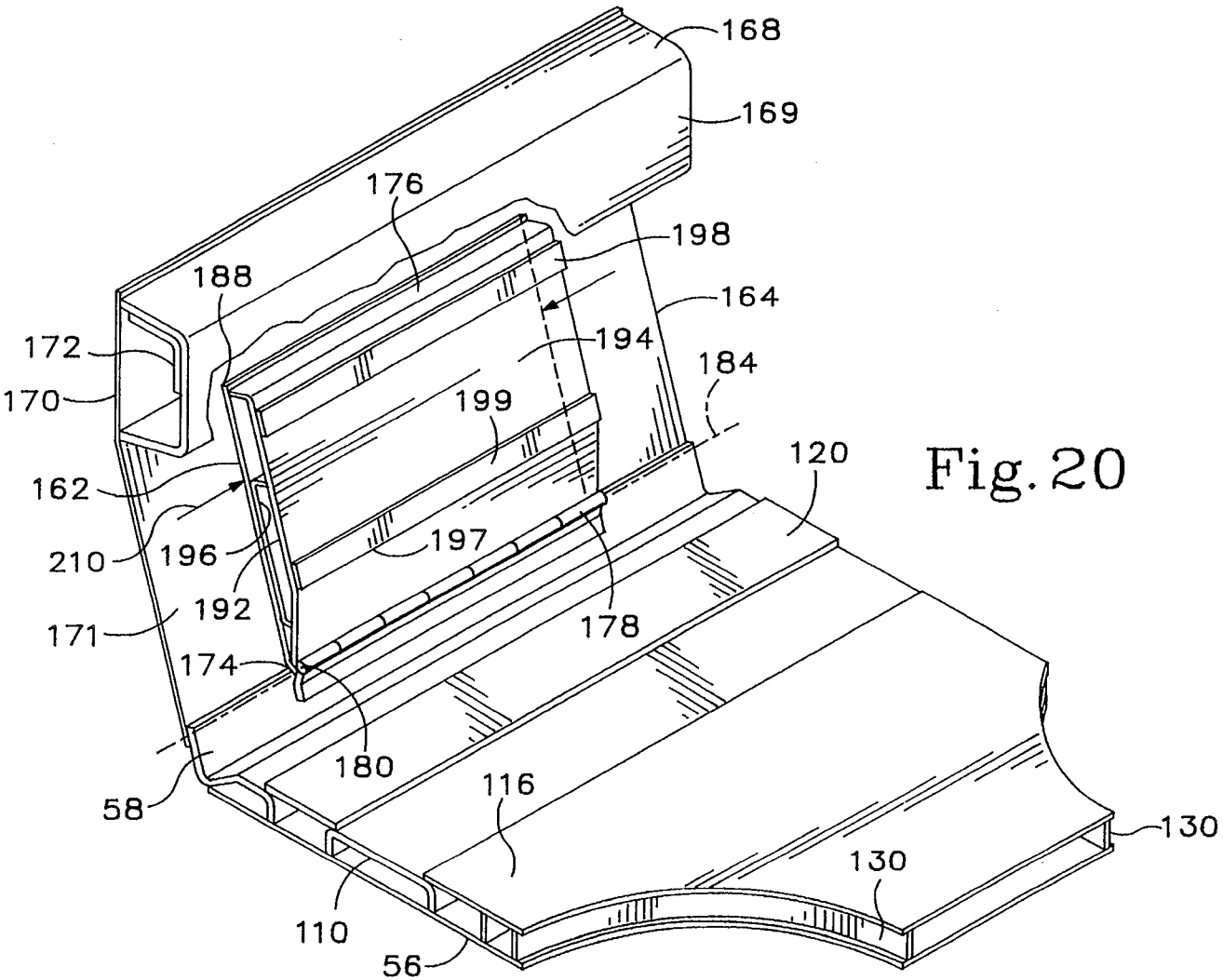
FIG. 20 is a perspective, partially cut-away view of a portion of a side sill and part of the well floor of the rail car shown in FIG. 18, showing the movable spacer in a raised, stowed position.
Figure 21:
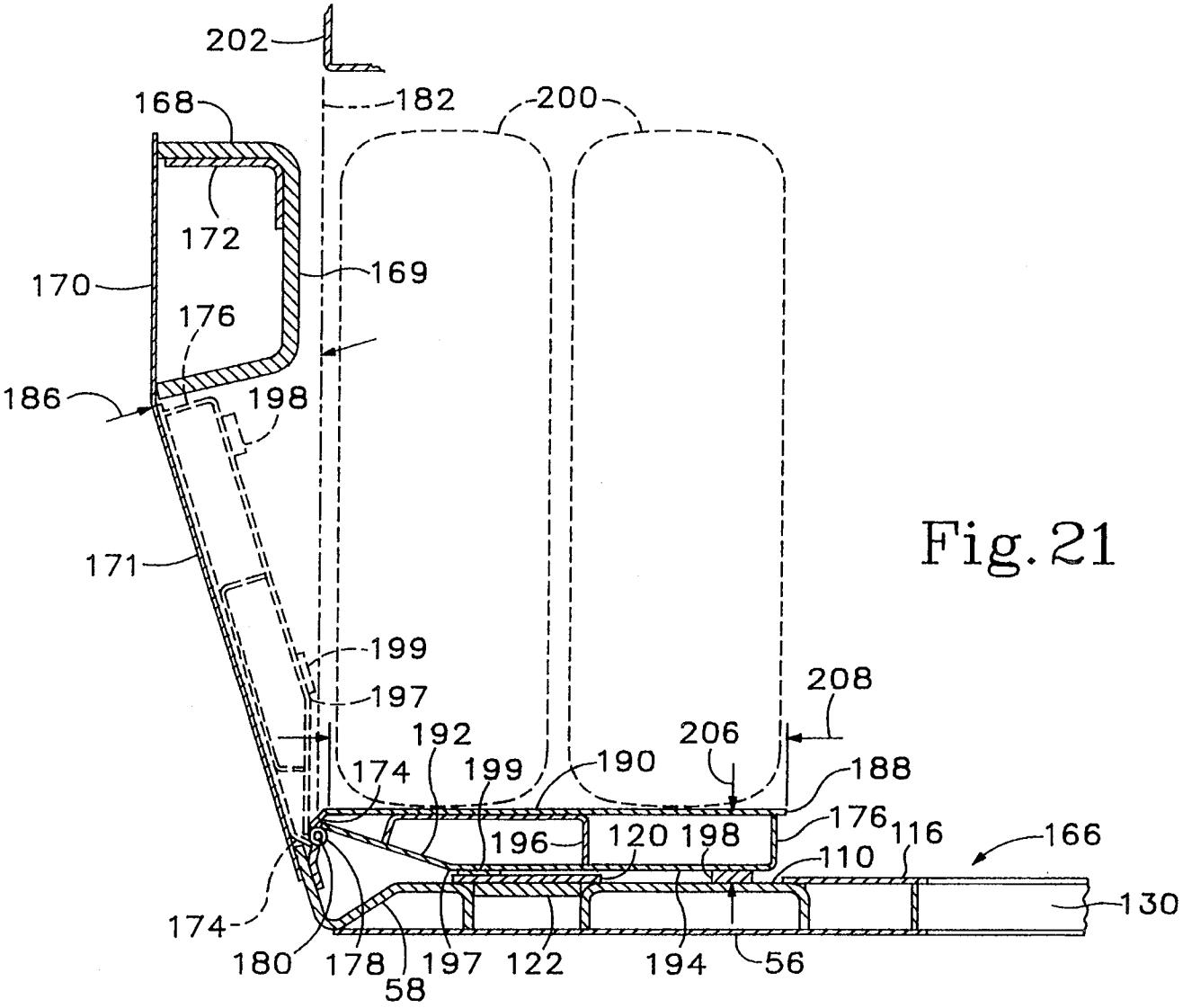
FIG. 21 is a sectional view taken along line 21—21 of FIG. 19, showing the movable spacer in its lowered, functional position.

As shown in FIGS. 20 and 21, each pivoting spacer 162 has a pivot side 174, attached to the car body 160 near the transition channel member 58, and a second side 176. The pivot side 174 of the spacer 162 is attached to the car body by any convenient pivoting structure, such as a barrel hinge 178, which permits the spacer 162 to pivot between a raised position, adjacent the side sill 164 and clear of the well floor 166, and a lowered, horizontal position adjacent the well floor 166. One flange of the hinge 178 is affixed to the car body 160, as by being welded to the transition channel 58, while the other flange is attached to the pivot side 174. The pivot axis 184 of the hinge is defined by a hinge pin 180 extending horizontally and longitudinally of the car body 160. It should be understood that the hinge could alternatively be attached to the web 171 of the side sill.

The car body 160 defines a vertical longitudinal plane 182 which is perpendicular to the generally horizontal well floor 166 and which defines the outside of the usable cargo well space for receiving a cargo container or a trailer. The web 171 of the side sill 164 is connected to the well floor 166 at an angle 186, relative to the plane 182, which is large enough to provide a recess for housing the spacer 162 adjacent the web 171 and beneath the top chord 168. The longitudinal pivot axis 184 of the hinge 178 is located close enough to the plane 182, and to the height of the top of the well floor 166, that the spacer 162 can be moved between the lowered position shown in FIG. 21 and the raised position shown in FIG. 20. The pivot axis 184 is also located far enough inboard, toward the center of the cargo well 22, that the center of gravity of the raised spacer 162 is outboard from the pivot axis 184. That is, the pivot axis 184 is closer to center of the cargo well 22 than is the center of gravity of the spacer 162, when the spacer 162 is in the raised position. Thus, the spacer remains in the raised, stowed position due to the effect of gravity, leaning outward against the web 171 and away from the center of the car body 160 and is thus outside the space which will be occupied by the cargo.

The spacer 162, in a preferred form, has a first, or top, plate 188 which has a first, or top, surface 190 which is horizontal when the spacer 162 is in its lowered, functional position as shown in FIG. 21. A second, or bottom, plate 192 has a main part 194 which is spaced apart from the top plate 188, parallel with a part of the bottom plate, and is bent to extend upward to the top plate 188 as an outer side wall 176. A bend 197, extending parallel with the pivot axis 184, defines an outboard portion of the bottom plate which converges toward the top plate 188 so that the distance between the plates 188, 192 decreases to a minimum distance at the pivot side 174. This permits the entire spacer 162 to remain outside the plane 182 defining the usable cargo well space when the spacer 162 is raised, as best shown in FIG. 21. The top plate 188 and the bottom plate 192 are interconnected along the pivot side 174 and the second side 176 of the spacer, and are additionally interconnected by a spacer reinforcing channel 196 having a base resting against and parallel with the plate 188, and legs extending to the bottom plate 192.

A foot 198 of steel of an appropriate thickness is attached to the second plate and rests on the longitudinal channel 110 when the spacer 162 is in its horizontal position, so that the top surface 190 of the spacer 162 is generally parallel with the well floor 166 and defines a height 206 sufficient to locate a lifting point 202 of a trailer 204 above the side sill 164 when the wheels 200 of the trailer 204 are resting atop the spacer 162, on the surface 190. A second foot 199 rests on the cover plate 120 when the spacer 162 is in its lowered horizontal position. The width 208 and length 210 (FIG. 20) of the first surface 190 of the spacer 162 are great enough to provide a sufficient area to support the wheels 200 of the trailer 204 when the extra height provided by the spacer 162 is required to permit easy loading and unloading of the trailer.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A railroad freight car which is capable of carrying either cargo containers or trailers, comprising:

(a) a car body including two longitudinally extending opposite side sills and a horizontal well floor extending between said side sills, said car body defining a cargo well between said side sills, each said side sill having a portion located higher than said well floor;

(b) a spacer having a pivot side and a top surface; and (c) a pivotal attachment connecting said pivot side to said car body and allowing said spacer to be pivoted between a raised position adjacent said side sill and a lowered horizontal position adjacent said well floor, said spacer in said raised position being located outside said cargo well, and said spacer in said horizontal position being located in said cargo well in position to support wheels of a trailer, with said top surface of said spacer located at a predetermined height above said well floor.

2. The freight car of claim 1 wherein said car body defines a plane which is perpendicular to said well floor, said plane defining the outside of said cargo well, and wherein at least one of said side sills defines a recess outside said plane, said spacer being located within said recess when in said raised position.

3. The freight car of claim 2 wherein said side sill includes a top chord and a web which extends diagonally downward and inward beneath said top chord at an angle to said plane sufficient to provide said recess adjacent said web and beneath said top chord.

4. The freight car of claim 1 wherein said pivotal attachment is a hinge interconnecting said pivot side with said car body and defining a horizontal pivot axis extending longitudinally of said car body.

5. The freight car of claim 4 wherein said car body includes a transition channel member located between and attached to one of said side sills and said well floor and said pivotal attachment is a hinge inter-connecting said pivot side with said transition channel member.

6. A railroad freight car for carrying either cargo containers or trailers, comprising:

(a) a car body defining a cargo well having a length and a width, said car body including a pair of longitudinally extending opposite side sills defining said width of said well and a horizontal well floor assembly extending between and supported by said side sills, said well floor assembly including a bottom plate extending over a majority of said length and a majority of said width of said well and a top plate spaced upwardly apart from said bottom plate and extending over a majority of said length and a majority of said width of said well, and said floor assembly including a plurality of vertically extending members interconnecting said bottom plate with said top plate and maintaining a vertical spacing therebetween;

(b) a spacer having a pivot side and a top surface; and (c) a pivotal attachment connecting said pivot side to said car body and allowing said spacer to be pivoted between a raised position adjacent one of said side sills and a lowered horizontal position adjacent said well floor, said top surface being located a predetermined distance above said well floor when said spacer is in said lowered horizontal position, and said spacer in said raised position being located outside said cargo well.

* * * * *